US007588499B2

(12) United States Patent
Tateno

(10) Patent No.: US 7,588,499 B2
(45) Date of Patent: Sep. 15, 2009

(54) PUTTER HEAD

(75) Inventor: Atsuo Tateno, Shinagawa-ku (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 235 days.

(21) Appl. No.: 11/783,353

(22) Filed: Apr. 9, 2007

(65) Prior Publication Data

US 2007/0238550 A1 Oct. 11, 2007

(30) Foreign Application Priority Data

Apr. 7, 2006 (JP) ..... 2006-106506

(51) Int. Cl.
*A63B 53/02* (2006.01)
*A63B 53/04* (2006.01)
*A63B 69/36* (2006.01)

(52) U.S. Cl. ..... 473/251; 473/305; 473/313; 473/338; 473/340; 473/342; 473/350

(58) Field of Classification Search ..... 473/219–256, 473/324–350, 313–314, 282–293; D21/736–746
See application file for complete search history.

(56) References Cited

U.S. PATENT DOCUMENTS

| | | | | | |
|---|---|---|---|---|---|
| 564,655 | A * | 7/1896 | Slade | 473/342 |
| 769,939 | A * | 9/1904 | Clark | 473/329 |
| 1,091,231 | A * | 3/1914 | Millar | 473/337 |
| 1,444,409 | A * | 2/1923 | Willmott | 473/343 |
| 2,346,617 | A * | 4/1944 | Schaffer | 473/305 |
| 3,042,405 | A * | 7/1962 | Solheim | 473/313 |
| 3,589,731 | A * | 6/1971 | Chancellor, Jr. | 473/333 |
| 3,770,279 | A * | 11/1973 | Phinny | 473/313 |
| 3,817,534 | A * | 6/1974 | Carlino | 473/337 |
| D235,668 | S * | 7/1975 | Swash | D21/739 |
| 4,010,958 | A * | 3/1977 | Long | 473/341 |
| 4,195,842 | A * | 4/1980 | Coleman | 473/337 |
| 4,313,607 | A * | 2/1982 | Thompson | 473/328 |
| 4,461,481 | A * | 7/1984 | Kim | 473/333 |
| 4,535,990 | A * | 8/1985 | Yamada | 473/346 |
| 5,700,207 | A * | 12/1997 | Guthrie et al. | 473/313 |
| 5,830,078 | A * | 11/1998 | McMahan | 473/252 |
| 5,993,324 | A * | 11/1999 | Gammil | 473/251 |
| 6,319,146 | B1 * | 11/2001 | Mills | 473/244 |
| 6,926,615 | B1 * | 8/2005 | Souza et al. | 473/251 |
| 6,929,564 | B2 * | 8/2005 | Olsavsky et al. | 473/340 |
| 7,048,646 | B2 * | 5/2006 | Yamanaka et al. | 473/332 |
| D537,134 | S * | 2/2007 | Imamoto | D21/736 |
| 7,396,295 | B1 * | 7/2008 | Frame et al. | 473/337 |
| D586,413 | S * | 2/2009 | D'Eath | D21/735 |
| 2004/0138004 | A1 * | 7/2004 | Grace | 473/340 |

FOREIGN PATENT DOCUMENTS

JP 2005-066249 A 3/2005

* cited by examiner

*Primary Examiner*—Sebastiano Passaniti
(74) *Attorney, Agent, or Firm*—Sughrue Mion, PLLC

(57) ABSTRACT

A putter head includes a head main body that defines a periphery of the putter head, and a bar that crosses a void space of the head main body in a forward-backward direction. The bar is inserted into insertion holes and fixed thereto by an adhesive. A face member is mounted on a recess. A shaft fixing hole is provided to pass through the bar from the top surface of a front portion of the head main body. A shaft is inserted into the shaft fixing hole and fixed thereto by an adhesive.

11 Claims, 4 Drawing Sheets

PUTTER HEAD

BACKGROUND OF THE INVENTION

1. Field of the Invention

The present invention relates to a putter head of a putter for golf, and in particular, to a putter head that is provided with a void space at its central part and a bar crossing the void space in a forward-backward direction.

2. Description of the Related Art

A putter head provided with a void space passing through the central part thereof in the thickness direction (vertical direction) and a bar crossing the void space in a forward-backward direction is disclosed in JP-A-2005-66249. By forming the void space, the moment of inertia about the gravity center is increased and the sweet area of the putter head is made larger. Further, a feeling of hitting sensation is improved by providing the bar crossing the void space in the forward-backward direction.

SUMMARY OF THE INVENTION

The putter head disclosed in JP-A-2005-66249 requires high dimensional accuracy in the structure because the bar is integrally formed with the putter head. Accordingly, it is an object of the invention to provide a putter head that can be easily manufactured.

According to JP-A-2005-66249, a shaft fixing hole is formed at the heel side. Thus, it is difficult to transmit a feeling of hitting sensation to a shaft.

It is another object of the invention to provide a putter head that can easily transmit a feeling of hitting sensation to a shaft.

According to a first aspect of the invention, a putter head includes a shaft fixing hole, a head main body that is provided with a void space, which is a through-hole vertically passing through the head main body at its central part or a concave portion recessed from a top surface of the head main body, and a bar that crosses the void space in a forward-backward direction. The head main body and bar are separate parts, the bar is inserted into a bar insertion hole extending from a front end surface or a rear end surface of the head main body in the forward-backward direction, and a cover is mounted on the head main body to close the bar insertion hole.

According to a second aspect of the invention, the shaft fixing hole is provided in the bar.

According to a third aspect of the invention, the shaft fixing hole is provided to pass through the bar from a top surface of the putter head.

According to a fourth aspect of the invention, a recess is formed in the front end surface of the putter head, the bar insertion hole is formed in a bottom wall of the recess, and a face member as a cover is mounted on the recess.

According to a fifth aspect of the invention, the recess is formed in the rear end surface of the putter head, the bar insertion hole is formed in a bottom wall of the recess, and a cover is mounted on the recess.

According to a sixth aspect of the invention, colors of the head main body and bar are different from each other.

According to a seventh aspect of the invention, a volume of the void space is in a range of 8000 to 100000 $mm^3$.

According to an eighth aspect of the invention, a length of the bar inside the void space is in a range of 30 to 80 mm.

The putter head according to the aspects of the invention is easily manufactured because a head and bar are separately manufactured.

According to the aspects of the invention, the shaft fixing hole is provided in the bar, or is provided to pass through the head main body and the bar, so that a feeling of hitting sensation is easily transmitted to a shaft. In addition, the shaft is inserted into the head main body and bar and fixed thereto, and thus fixing strength of the bar increases.

According to the aspects of the invention, the recess is formed in the front end surface of the putter head, the bar insertion hole is formed in the bottom wall of the recess, and the cover, that is, the face member is mounted on the recess. Therefore, a feeling of hitting sensation is easily transmitted to the shaft.

According to the aspects of the invention, the recess is formed in the rear end surface of the putter head, the bar insertion hole is formed in the bottom wall of the recess, and the cover is mounted on the recess. Therefore, the putter head can be easily manufactured.

According to the aspects of the invention, the head main body and bar have different colors, so that the bar implicitly indicates a back swing direction and a rolling direction of a ball.

DETAILED DESCRIPTION OF THE PREFERRED EMBODIMENTS

An embodiment of the invention will now be described in detail with reference to FIGS. 1 to 6.

Figure 1:
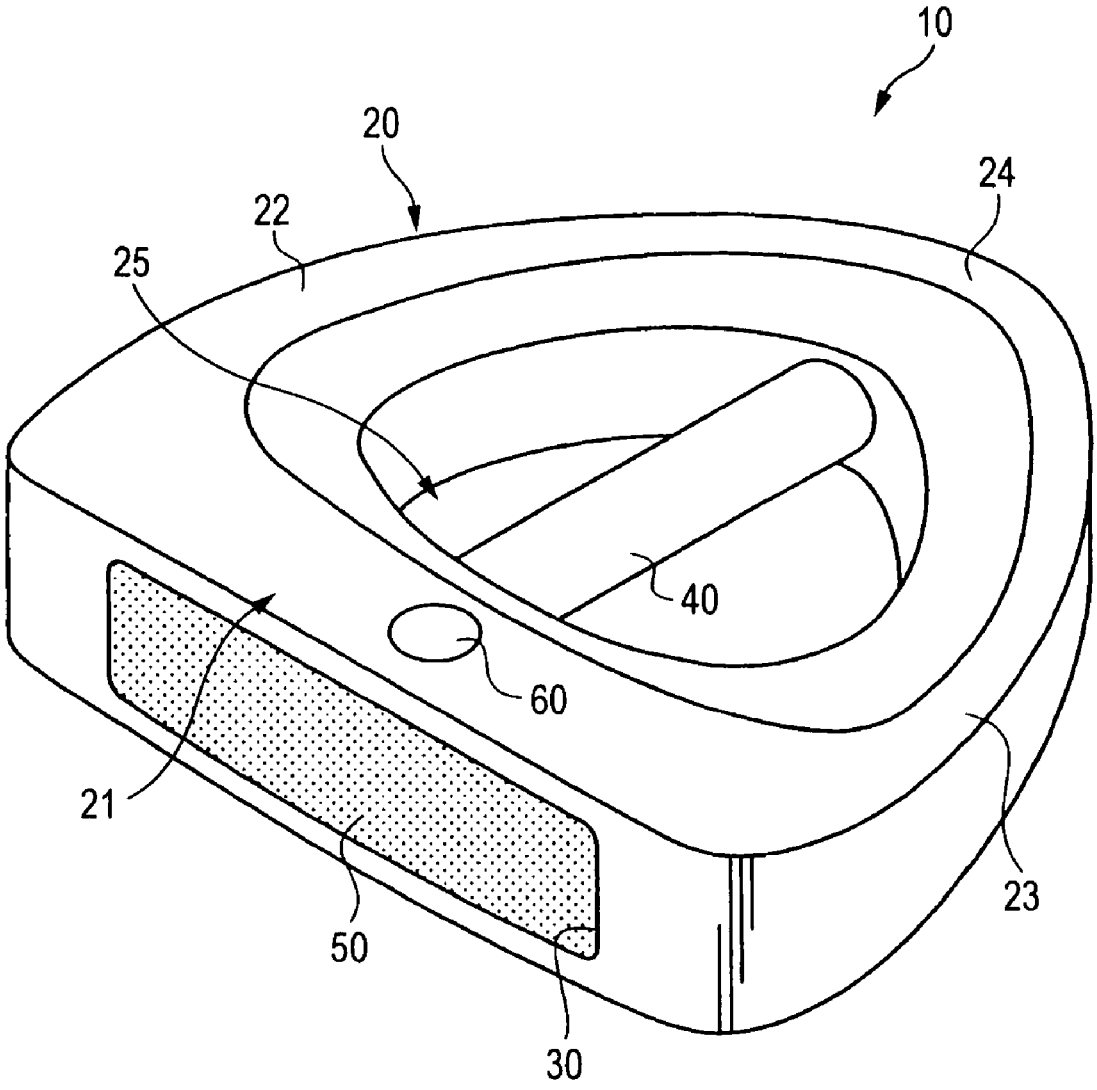
FIG. 1 is a perspective view of a putter head according to an embodiment of the invention.
Figure 2A:
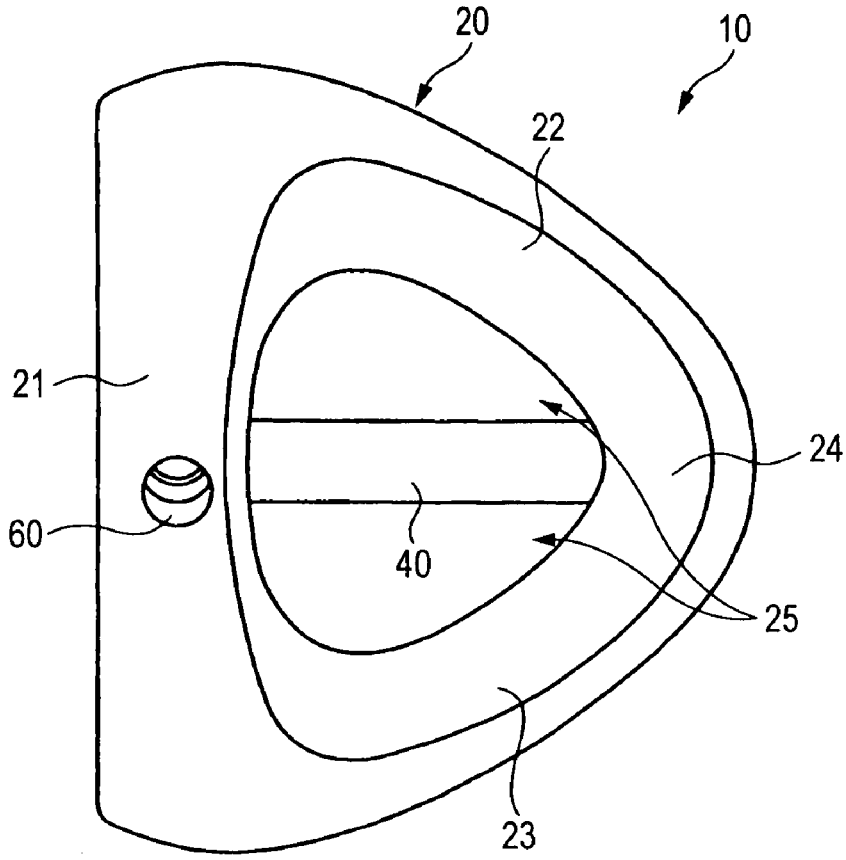
FIGS. 2A and 2B are a plan view and a side view of the putter head, respectively.
Figure 2B:
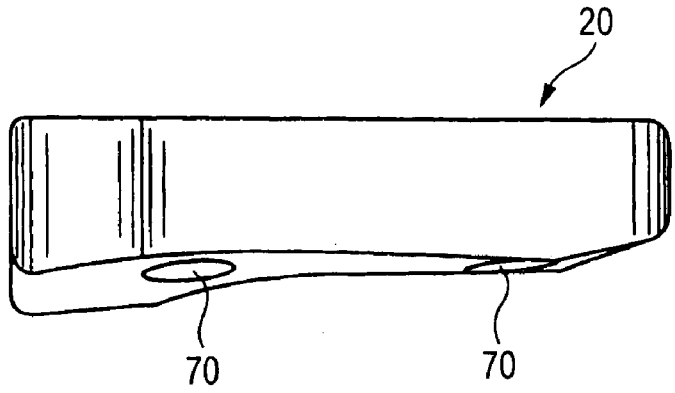
Figure 3:
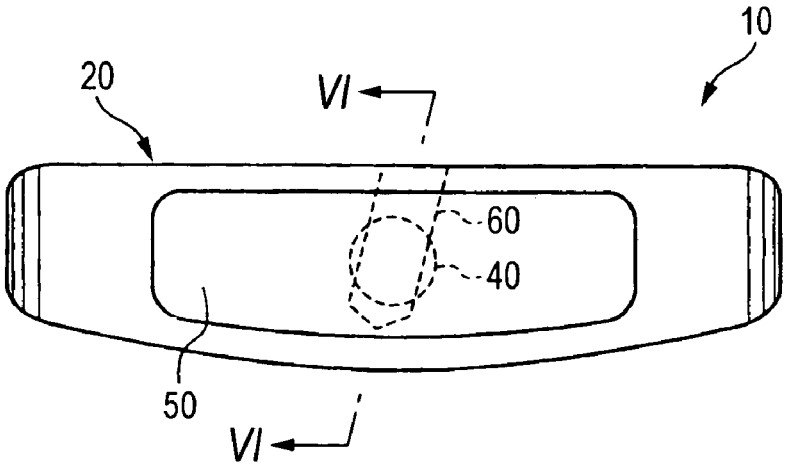
FIG. 3 is a front view of the putter head.
Figure 4:
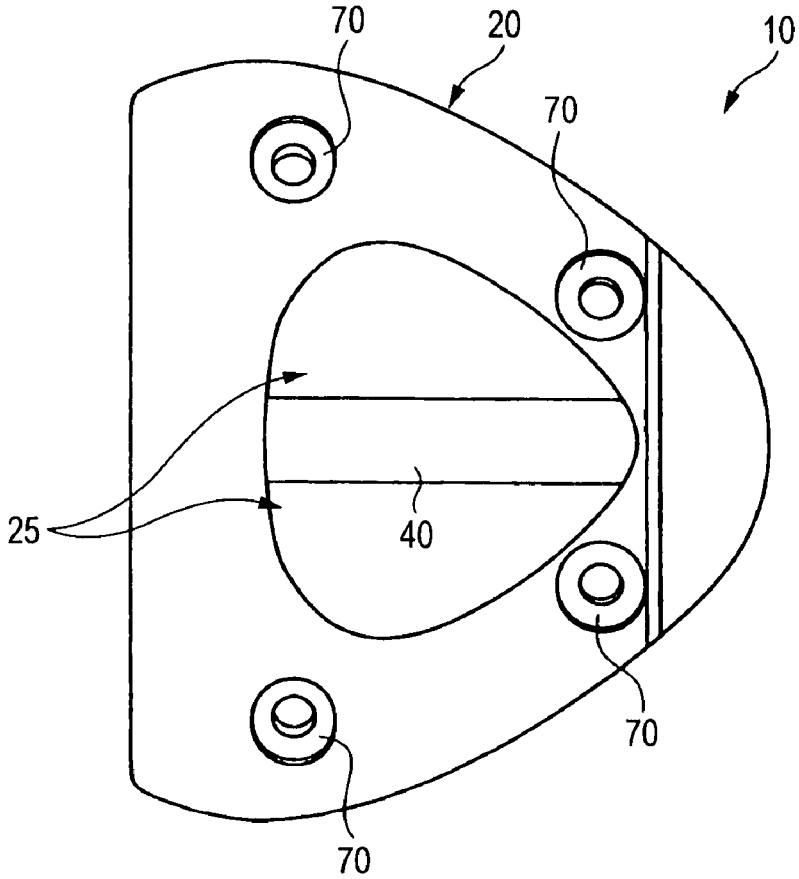
FIG. 4 is a bottom view of the putter head.
Figure 5:
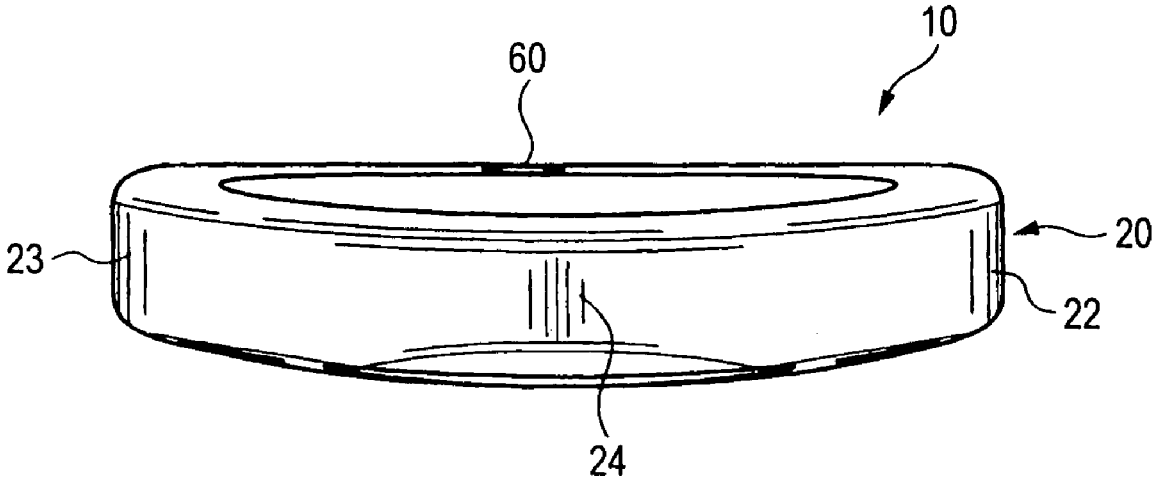
FIG. 5 is a rear view of the putter head.
Figure 6:
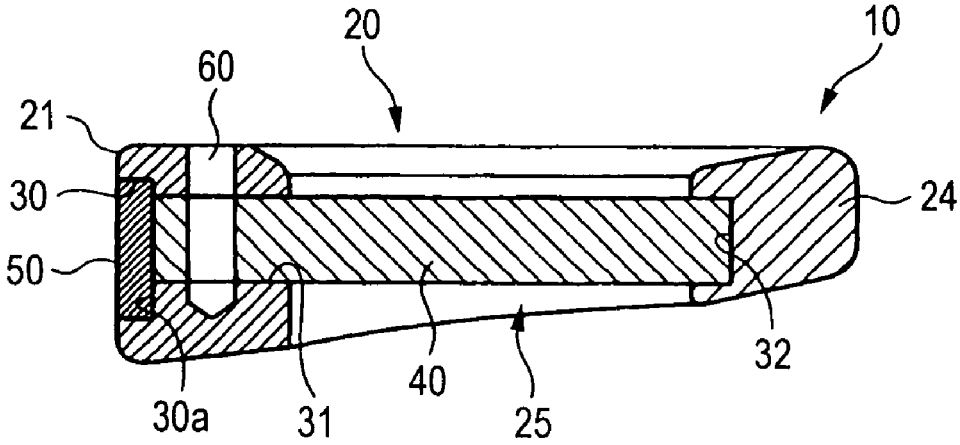
FIG. 6 is a cross-sectional view taken along line VI-VI of FIG. 3.

FIG. 1 is a perspective view of a putter head according to an embodiment of the invention. FIG. 2A is a plan view of the putter head. FIG. 2B is a left side view of the putter head. FIG. 3 is a front view of the putter head. FIG. 4 is a bottom view of the putter head. FIG. 5 is a rear view of the putter head. FIG. 6 is a cross-sectional view of the putter head taken along line VI-VI of FIG. 3.

A putter head 10 includes a head main body 20 that defines the outer periphery of the putter head, and a bar 40 that crosses a void space of the head main body 20 in a forward-backward direction.

The head main body 20 has a front portion 21, a tow side portion 22, a heel side portion 23, and a back portion 24 where the tow and heel side portions 22 and 23 are joined. The tow side portion 22 extends backward from the tow of the front portion 21 to the center of the back portion 24 between the tow and heel sides of the putter head. The heel side portion 23 extends backward from the heel of the front portion 21 to the center of the putter head. Therefore, the head main body 20 substantially has a triangular frame shape in plan view.

In this embodiment, a substantially triangular void space 25 surrounded by the front portion 21, the side portions 22 and 23, and the back portion 41 is provided. The void space 25 passes through an upper surface and a lower surface of the head main body 20.

As shown in FIG. 6, a recess 30 is formed in the front surface (face) of the head main body. The recess 30 occupies a main area of the face. The length of the recess 30 in the toe-heel direction is preferably 35 to 95 percent, and particularly, 45 to 90 percent of the length of the face in the toe-heel direction. Further, the vertical width of the recess 30 is preferably 70 to 98 percent, particularly, 75 to 95 percent of the width of the face in the vertical direction. The depth of the recess 30 is preferably 0.5 mm or more, for example, 2 to 6 mm.

A first insertion hole 31 passes through from a bottom wall 30*a* of the recess 30 to the void space 25. A second insertion hole 32 is formed in the back portion 24 along the extension line of the first insertion hole 31. The second insertion hole 32 is recessed from the inside of the void space 25, but does not extend to a rear end surface of the head main body 20.

The bar 40 is inserted into the insertion holes 31 and 32 and fixed thereto by an adhesive. In this embodiment, the bar 40 is configured to have a cylindrical solid body and its front end surface is flush with the bottom wall 30*a* of the recess 30.

A face member 50 is attached to the recess 30. The face member 50 may be formed of a material, such as synthetic resin, elastomer, rubber, metal, ceramics, carbon, or the like.

Preferably, the face member 50 is fixed by an adhesive. When the face member 50 is formed of a metal, the face member can be fixed by caulking, thermal insert, or cooling insert etc.

A shaft fixing hole 60 is provided in the putter head 10 to pass through the bar 40 from the top face of the front portion 21 of the head main body 20. A shaft (not shown) is inserted into the shaft fixing hole 60 and fixed by adhesive. In this embodiment, the shaft fixing hole 60 passes through the bar 40, but does not extend to the bottom of the head main body 20, so as to form a concavity. The shaft fixing hole 60 has a diameter less than a diameter of the bar 40 and passes through the bar like a through-hole. The axis of the shaft fixing hole 60 is inclined toward the heel side as it goes upwards, and preferably crosses the axis of the bar 40.

As shown in FIG. 4, at a plurality of positions of the bottom of the head main body 20, weights 70 formed of a material with high specific gravity ranging from 7.8 to 12, such as stainless, tungsten, tungsten-nickel alloy, or the like, are fixed to the head main body 20 by screwing or caulking. Each of the weights 70 does not protrude from the bottom of the head main body 20.

In this embodiment, the head main body 20 and the bar 40 are formed of an aluminum alloy, not including the weights 70, with specific gravity of 2.7 to 2.8. Further, at least one of the outer surfaces of the head main body 20 and the bar 40 is anodized, which makes them to have different colors. In particular, it is preferable that the bar 40 is colored with a dark color, such as blue, and the head main body 20 is colored with a light color, such as silver, gray, or white.

According to the putter head having the above-described configuration, the head main body 20 and the bar 40 are separate parts and easily manufactured. Further, assembling of the putter head including the assembly of the head main body 20 and the bar 40 is simplified because the bar 40 is inserted into the first and second insertion holes 31 and 32 in sequence and the face member 50 is mounted thereafter.

In this embodiment, since the shaft fixing hole 60 is provided to pass through the head main body 20 and the bar 40, a player can easily feel a hitting sensation through the shaft.

According to this embodiment, since the void space 25 is formed, the moment of inertia of the putter head increases and a hit ball stably rolls. The volume of the void space 25 (except for the bar 40) is preferably in a range of 8000 to 100000 $mm^3$, and particularly, 15000 to 80000 $mm^3$.

In this embodiment, because the bar 40 crosses the void space 25 in the forward-backward direction, a player can easily estimate a back swing direction and a rolling direction of a ball. In particular, a player effectively estimates the directions when the head main body 20 and the bar 40 have different colors.

It is preferable that the axis of the bar 40 has an angle ranging from 87 to 93°, and particularly, 90° with respect to the toe-heel direction of the face.

Preferably, the length of the bar 40 inside the void space 25 is in a range of 30 to 80 mm, and the diameter of the bar 40 is in a range of 10 to 13 mm. The diameter of the bar 40 is preferably larger than that of the shaft fixing hole 60 by 1 mm or more, e.g., in a range of 1 to 5 mm.

The bar 40 is a solid bar, but may be a hollow cylinder. The bar 40 may be an ellipse column, an ellipse hollow column, a square column or a square hollow column.

The length of the first insertion hole 31 (the length from the bottom wall 30*a* to the void space 25) is preferably in a range of 3 to 25 mm, particularly, 5 to 20 mm. The depth of the second insertion hole 32 is preferably 3 mm or more, for example, in a range of 3 to 10 mm.

The above-described embodiment is just an example of the invention, and the invention can include other configurations not shown in the drawings. For example, an insertion hole passing through a head main body from the rear end surface to a central hole may be formed, and a bar may be inserted into the insertion hole from the rear side. In addition, an opening of the insertion hole at the rear end may be closed by a closing means, such as a cap. The closing means may be fixed by a screw or an adhesive. An elastic body, such as rubber, may be interposed between the bar and the closing means.

In this case, an elastic body, such as rubber, may be interposed between the foremost end of the insertion hole and the bar.

The bar inserted in the insertion hole may be fixed by screwing.

Although the void space 25 is a through-hole that passes through the head main body in the thickness wise direction in the above-described embodiment, a hole may be recessed from the top surface and have a bottom.

What is claimed is:

1. A putter head formed with a shaft fixing hole, comprising:

a head main body formed with a void space at its central part; and a bar that crosses the void space in a forward-backward direction, wherein:

the head main body and the bar are separate parts, the bar extends longitudinally from front to rear and is centrally located from heel toe, the bar is inserted into a bar insertion hole extending from a front end surface or a rear end surface of the head main body in the forward-backward direction, a cover is mounted on the head main body to close the bar insertion hole, and the shaft fixing hole is provided in the bar.

2. The putter head according to claim 1, wherein a recess is formed in the front end surface of the putter head, the bar insertion hole is formed in a bottom wall of the recess, and a face member as the cover is mounted on the recess.

3. The putter head according to claim 1, wherein a recess is formed in the rear end surface of the putter head, the bar insertion hole is formed in a bottom wall of the recess, and the cover is mounted on the recess.

4. The putter head according to claim 1, wherein colors of the head main body and the bar are different from each other.

5. The putter head according to claim 1, wherein a volume of the void space is in a range of 8000 to 100000 $mm^3$.

6. The putter head according to claim 1, wherein a length of the bar inside the void space is in a range of 30 to 80 mm.

7. The putter head according to claim 1, wherein the void space is a through-hole vertically passing through the head main body.

8. The putter head according to claim 1, wherein the void space is a concave portion recessed from a top surface of the head main body.

9. A putter head formed with a shaft fixing hole, comprising:

a head main body formed with a void space at its central part; and a bar that crosses the void space in a forward-backward direction, wherein:

the head main body and the bar are separate parts, the bar extends longitudinally from front to rear and is centrally located from heel to toe, the bar is inserted into a bar insertion hole extending from a front end surface or a rear end surface of the head main body in the forward-backward direction, a cover is mounted on the head main body to close the bar insertion hole, and the shaft fixing hole extends from a top surface of the head main body at a front portion of the putter head through the bar.

10. The putter head according to claim 9, wherein a recess is formed in the front end surface of the putter head, the bar insertion hole is formed in a bottom wall of the recess, and a face member as the cover is mounted on the recess.

11. The putter head according to claim 9, wherein a recess is formed in the rear end surface of the putter head, the bar insertion hole is formed in a bottom wall of the recess, and the cover is mounted on the recess.

* * * * *